US009110408B1

(12) United States Patent
Craig et al.

(10) Patent No.: US 9,110,408 B1
(45) Date of Patent: Aug. 18, 2015

(54) ADJUSTING TONE REPRODUCTION CURVE AND BELT TENSION TO CONTROL PRINTING ERRORS

(71) Applicant: XEROX CORPORATION, Norwalk, CT (US)

(72) Inventors: David C. Craig, Pittsford, NY (US); David R. Kretschmann, Webster, NY (US); Eliud Robles Flores, Rochester, NY (US); Jorge M. Rodriguez, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 14 days.

(21) Appl. No.: 14/188,047

(22) Filed: Feb. 24, 2014

(51) Int. Cl.
*G03G 15/00* (2006.01)
*G03G 15/16* (2006.01)

(52) U.S. Cl.
CPC ..... *G03G 15/1615* (2013.01); *G03G 15/505* (2013.01)

(58) Field of Classification Search
USPC ..... 399/49
See application file for complete search history.

(56) References Cited

U.S. PATENT DOCUMENTS

| | | | | |
|---|---|---|---|---|
| 5,289,251 | A | 2/1994 | Mandel et al. | |
| 5,946,523 | A * | 8/1999 | Fujioka et al. | 399/49 |
| 6,173,952 | B1 | 1/2001 | Richards et al. | |
| 7,174,237 | B2 * | 2/2007 | Takayama et al. | 700/230 |
| 7,684,083 | B2 | 3/2010 | Robles-Flores | |
| 8,474,818 | B2 | 7/2013 | Dejong et al. | |
| 8,579,287 | B1 | 11/2013 | Herrmann et al. | |
| 2005/0271429 | A1 * | 12/2005 | Tachibana et al. | 399/301 |
| 2010/0046969 | A1 * | 2/2010 | Kim et al. | 399/43 |
| 2011/0262163 | A1 * | 10/2011 | Koizumi | 399/66 |
| 2013/0200564 | A1 | 8/2013 | Choi et al. | |

* cited by examiner

*Primary Examiner* — Clayton E Laballe
*Assistant Examiner* — Linda B Smith
(74) *Attorney, Agent, or Firm* — Gibb & Riley, LLC

(57) ABSTRACT

When performing a printing operation, methods and devices automatically increase a marking material quantity setting when an excessive speed variation condition of a transfer surface is present and an excessive background marking condition is absent. Alternatively, the methods and devices automatically increase tension of the transfer surface and decrease a marking material quantity setting when the excessive speed variation condition is present and the excessive background marking condition is also present. Otherwise, these methods and devices automatically provide a message on the graphic user interface of a printing device when the excessive speed variation condition is present, the marking material quantity setting is at a marking material quantity maximum setting, and the tension of the transfer surface is at a tension maximum. The message provides instructions to use a different type media or initiate a service call.

20 Claims, 4 Drawing Sheets

ADJUSTING TONE REPRODUCTION CURVE AND BELT TENSION TO CONTROL PRINTING ERRORS

BACKGROUND

Systems and methods herein generally relate to printing devices, and more particularly to methods and devices that adjust the tone reproduction curve (TRC) and intermediate transfer belt/photoreceptor belt tension to control printing errors.

When running large, thick sheets in a printing device, an undesirable "short paper path" condition can occur. The short paper path condition occurs when a sheet is simultaneously held by two immediately adjacent nips in the paper path. Thus, a short paper path condition occurs, for example, when the leading edge of a sheet of media enters a fuser of an electrostatic printer, while the trailing edge of the sheet is still in the transfer nip. When the sheet is simultaneously held by both nips, disturbances can be transferred to other areas of the printing device, producing printing errors. Structures in which the short paper path condition can occur are sometimes referred to as dual nip systems.

The short paper path condition can be compounded if the large sheet is also thick, because the media leading edge entry into the fuser may become unstable. This instability can manifest itself as a stalling of the fuser or a speed-up of the fuser, as the control systems attempts to swallow the thick media. This stalling/speed-up is problematic, and because the transfer nip is simultaneously engaged with the fuser nip, the short paper path condition can send a series of disturbances back to the imaging units. These disturbances may manifest themselves as bands, which may be visible in colors, especially darker colors, such as magenta and black.

SUMMARY

An exemplary printing device includes a transfer surface (e.g., a photoreceptor or an intermediate transfer belt) performing a printing activity that forms marks on sheets of print media by transferring patterned marking material onto imaged areas of the sheets of print media (and not transferring marking material onto non-imaged areas of the sheets of print media). Further, the exemplary printing device has an encoder operatively connected to the transfer surface. The encoder automatically monitors movement speed of the transfer surface. Also, a spectrophotometer is adjacent the sheets of print media. The spectrophotometer automatically monitors the amount of marking material being transferred to the non-imaged areas of the sheets of print media during the printing activity. A processor is operatively (meaning directly or indirectly) connected to the encoder and the spectrophotometer. Also, a graphic user interface is operatively connected to the processor.

The processor automatically monitors variation of the movement speed of the transfer surface based on output from the encoder. The processor automatically determines if the variation of the movement speed of the transfer surface exceeds a predetermined speed variation limit to identify an excessive speed variation condition. The processor also automatically determines if the amount of the marking material being transferred to the non-imaged areas of the sheets of print media exceeds a perceptibility threshold to identify an excessive background marking condition.

The processor automatically increases a marking material quantity setting (e.g., a tone reproduction curve setting for one color (e.g., yellow) or multiple colors) when the excessive speed variation condition is present and the excessive background marking condition is absent. This process of increasing the marking material quantity setting is performed in increments up to a marking material quantity maximum setting.

Alternatively, the processor automatically increases tension of the transfer surface and decreases the marking material quantity setting when the excessive speed variation condition is present and the excessive background marking condition is also present. The process of increasing tension of the transfer surface is similarly performed in increments up to a tension maximum. The processor decreases the marking material quantity setting by decreasing the marking material quantity setting to a relative minimum allowed for the marking material quantity setting within the printing device.

Otherwise, the processor automatically provides a message on the graphic user interface of the printing device when the excessive speed variation condition is present, the marking material quantity setting is at the marking material quantity maximum setting, and the tension of the transfer surface is also at the tension maximum. The message provides instructions to use a different weight media or initiate a service call.

The processor increases tension of the transfer surface, increases the marking material quantity setting, and decreases the marking material quantity setting by changing the tension of the transfer surface and the marking material quantity setting from relative normal settings. The processor returns the tension of the transfer surface and the marking material quantity setting to the relative normal settings when the excessive speed variation condition is absent.

Also, the processor continues the printing activity without interruption even while increasing tension of the transfer surface, increasing the marking material quantity setting, and decreasing the marking material quantity setting, until the excessive speed variation condition is present, the marking material quantity setting is at the marking material quantity maximum setting, and the tension of the transfer surface is at the tension maximum (at which time, the processor automatically provides the above message on the graphic user interface).

An exemplary method herein automatically monitors variation of movement speed of a transfer surface (e.g., a photoreceptor or an intermediate transfer belt) within a printing device performing a printing activity (using a processor of the printing device). This printing activity forms marks on sheets of print media. More specifically, the transfer surface transfers patterned marking material onto imaged areas of the sheets of print media (and does not transfer marking material onto non-imaged areas of the sheets of print media). The method automatically monitors the amount of marking material being transferred to such non-imaged areas of the sheets of print media during the printing activity (using the processor).

This exemplary method also automatically determines if the variation of movement speed of the transfer surface exceeds a predetermined speed variation limit to identify an excessive speed variation condition (using the processor). The method also automatically determines if the amount of marking material being transferred to the non-imaged areas of the sheets of print media exceeds a perceptibility threshold to identify an excessive background marking condition using the processor.

With the foregoing, this method automatically increases a marking material quantity setting (e.g., a tone reproduction curve setting for one color (e.g., yellow, clear, etc.) or multiple colors) when the excessive speed variation condition is present and the excessive background marking condition is absent (using the processor). The process of increasing the marking material quantity setting is performed in increments up to a marking material quantity maximum setting.

Alternatively, this method automatically increases tension of the transfer surface and decreases the marking material quantity setting when the excessive speed variation condition is present and the excessive background marking condition is also present (using the processor). The process of increasing tension of the transfer surface is performed in increments up to a tension maximum. The process of decreasing the marking material quantity setting decreases the marking material quantity setting to a relative minimum allowed for the marking material quantity setting within a given printing device.

This method continues the printing activity without interruption even while increasing tension of the transfer surface, increasing the marking material quantity setting, and decreasing the marking material quantity setting (until the excessive speed variation condition is present at the same time the marking material quantity setting is at the marking material quantity maximum setting and the tension of the transfer surface is at the tension maximum).

Otherwise, this method automatically provides a message on the graphic user interface of the printing device when the excessive speed variation condition is present, at the same time the marking material quantity setting is at the marking material quantity maximum setting and the tension of the transfer surface is at the tension maximum. The message provides instructions to use a different weight media or initiate a service call.

The processes of increasing the tension of the transfer surface, increasing the marking material quantity setting, and decreasing the marking material quantity setting change the tension of the transfer surface and the marking material quantity setting from relative normal settings. Further, this method returns the tension of the transfer surface and the marking material quantity setting to the relative normal settings when the excessive speed variation condition is absent.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As mentioned above, the "short paper path" condition can occur when the leading edge of a sheet of media enters a fuser of an electrostatic printer while the trailing edge of the sheet is still in the transfer nip, and this can cause disturbances to be transferred to other areas of the printing device, producing printing errors.

Therefore, the systems and methods herein provide a closed loop control for such dual nip systems. The methods and devices herein are useful for thick large sheets in short paper path conditions, and the systems and methods herein minimize banding artifacts, such as magenta and black banding artifacts. The systems and methods herein use an input-process-output structure based on available signal/devices. Without such a closed loop, users or printers may default to calling a service engineer, which unnecessarily expends time and resources.

Thus, the methods and devices herein use a closed loop control for the dual nip structures based on available signal/devices. The methods and devices herein are actuated by changing the photoreceptor tension and color background dusting, which enables slip in the transfer nip. The acceptable range for such actuations is determined empirically for each different type of printing device. The methods and devices herein are engaged when the speed variation of the photoreceptor exceeds the perceptibility threshold. The color background toner dusting is gradually increased to promote nip slippage and the tension of the belt is increased to reduce vibrations until both reach their maximum limit (determined empirically) while continuing to make prints. When the maximum limit of both actuators are reached, a service call can be made.

Figure 1:
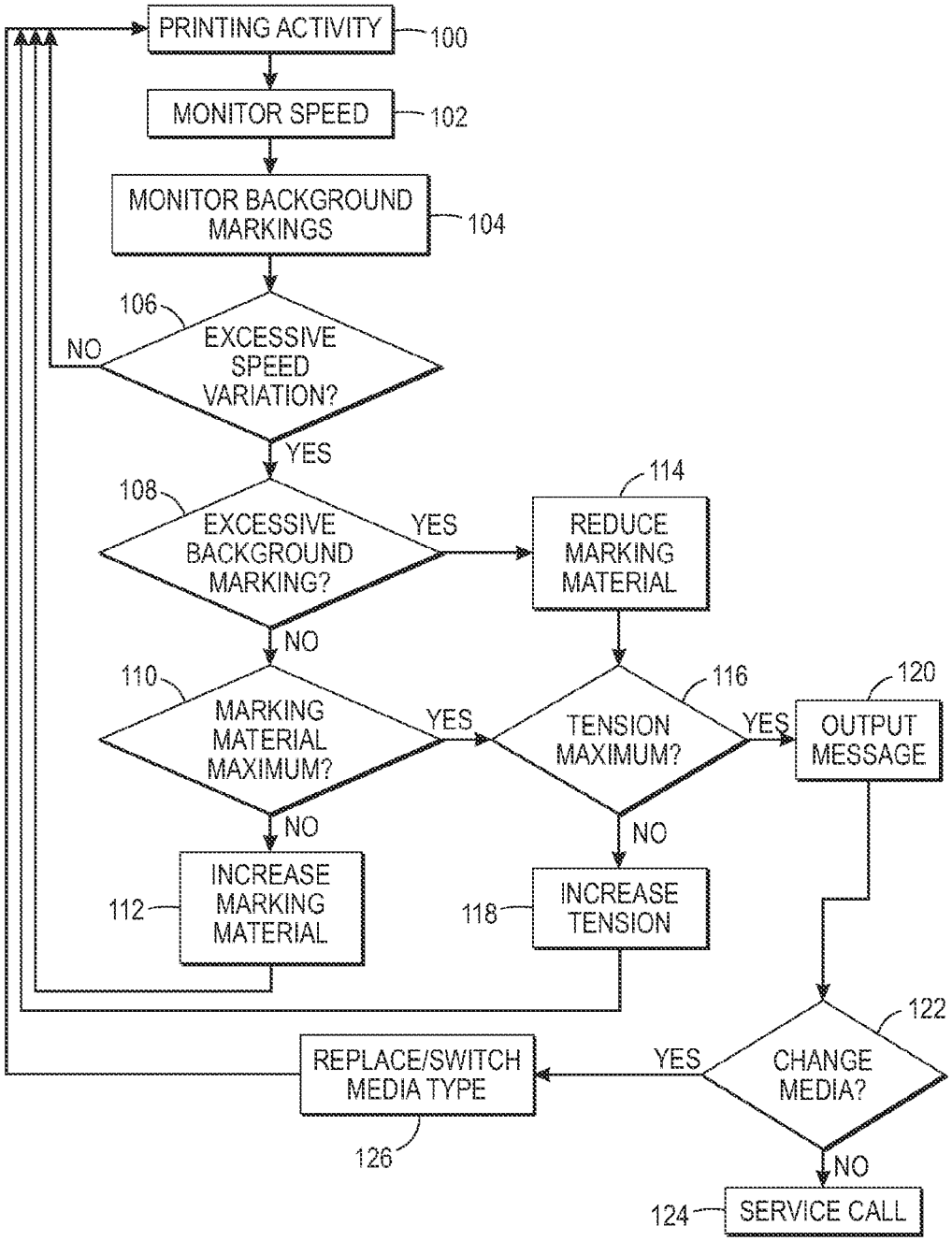
FIG. 1 is a flow diagram of various methods herein.

FIG. 1 is flowchart illustrating an exemplary method herein. In item 100 the method performs a printing activity using a transfer surface (e.g., a photoreceptor or an intermediate transfer belt) within a printing device. This printing activity forms marks on sheets of print media. More specifically, the transfer surface transfers patterned marking material onto imaged areas of the sheets of print media (and does not transfer marking material onto non-imaged areas of the sheets of print media).

In item 102, this method automatically monitors variation of movement speed of the transfer surface (using a processor of the printing device) and, in item 104, automatically monitors the amount of marking material being transferred to the non-imaged areas of the sheets of print media during the printing activity (using the processor).

In item 106, this method automatically determines if the variation of movement speed of the transfer surface over time exceeds a predetermined speed variation limit to identify an "excessive speed variation condition" (using the processor). For example, in some situations, speed variations greater than 3% may produce visible print errors. In other situations, this speed variation limit may be lower (e.g., 1.5%) or may be higher (e.g., 5%, 8%, 15%, etc.) as each different printing device handles disruptions differently. If the excessive speed variation condition is not present (is absent), processing returns to the printing operation in item 100 with all print parameters at their normal (unadjusted) settings.

However, if the excessive speed variation condition is present, processing proceeds to item 108, where this method automatically determines if the amount of marking material being transferred to the non-imaged areas of the sheets of print media exceeds a perceptibility threshold to identify an "excessive background marking condition" (using the processor). When both the excessive speed variation condition is present (item 106) and the excessive background marking condition is present (item 108), this method automatically decreases a marking material quantity setting (e.g., a tone reproduction curve setting for one color (e.g., red, green, blue, cyan, magenta, yellow, black, etc.) or multiple colors in item 114, and (if the tension is not at its maximum setting, per item 116) increases tension of the transfer surface (in item 118).

The process of decreasing the marking material quantity setting in item 114 may decrease the setting to zero immediately, or may decreases the marking material quantity setting incrementally down to a relative minimum allowed for a given printing device. For example, if a tone reproduction curve measure of zero is the lowest setting allowed in a certain printing device, item 114 can immediately decrease the tone reproduction curve to zero, or incrementally decrease the tone reproduction curve by 1, 0.5, 0.2, etc., until the lowest setting allowed (e.g., zero) is reached.

The process of increasing tension of the transfer surface in item 118 may also be performed in a single step or in increments up to the tension maximum. For example, the tension can be increased by 2%, 5%, 10%, 20%, etc., at each pass through the process up to a tension maximum (e.g., normal tension plus 30%, 35%, 50%, etc.).

However, when the excessive speed variation condition is present (item 106) but the excessive background marking condition is not present (absent) as shown in item 108 (and the marking material setting is not at its maximum per item 110) this method automatically increases the marking material quantity setting in item 112 to provide a dusting of marking material for nip lubrication. The process of increasing the marking material quantity setting is performed in increments (by changing the tone reproduction curve by 1, 0.5, 0.2, etc.) up to a marking material quantity maximum setting.

The color(s) of marking material (e.g., toner, dry ink, powdered marking material, etc.) that are adjusted by the methods and devices herein to provide lubrication in the nips to combat the excessive speed variation condition (e.g., to combat the short paper path condition) can be the colors that have particle sizes and shapes that promote the most slippage, relative to the other colors available. Further, the color and amount marking material added to the non-imaged areas of the sheet can be selected based on empirical testing so that the marking material added to the non-imaged areas promotes slippage of the sheet within the nip(s), without being detectable by the user in the final printed sheet.

For example, a small amount of yellow or clear toner transferred to the non-imaged (background) areas of the sheet can help increase nip slippage (and limit disturbances or vibrations from being transferred back to the imagers when a large sheets is simultaneously held by the transfer nip and the fuser nip); yet because yellow is such a light color, light yellow markings in the non-imaged sheet areas may be imperceptible to the user (when used in small quantities).

The color of marking material chosen, the amount of marking material used, the amount of intermediate transfer belt or photoreceptor tension, etc., has been determined for different printers experimentally, and each printer can use different combinations of small amounts of background marking material as nip lubricant, with different belt tensions to prevent disturbances or vibrations from being transferred back to the imagers when a large sheets are simultaneously held by the transfer nip and the fuser nip. As would be understood by those ordinarily skilled in the art, the claims that are presented below are intended to include all such variations that are used to accommodate the differences of different printing devices, whether such printers are currently known or developed in the future.

As shown by the return arrows from items 106, 112, and 118 to item 100, this method continues the printing activity without interruption even while increasing the marking material quantity setting 112, decreasing the marking material quantity setting 114, and/or increasing tension of the transfer surface 118. This printing continues without interruption until the excessive speed variation condition is present (item 106) at the same time both the marking material quantity setting is at the marking material quantity maximum setting (item 110) and the tension of the transfer surface is at the tension maximum (item 118).

When this occurs, processing proceeds to item 120, where this method automatically provides a message on the graphic user interface of the printing device (e.g., when the excessive speed variation condition (item 106) is present, at the same time both the marking material quantity setting is at the marking material quantity maximum setting (item 110) and the tension of the transfer surface is at the tension maximum (item 116)). As shown in item 122, the message provides instructions to use a different weight, length, or type of media (item 126) or to initiate a service call (124). If the media is replaced or switched in item 126, processing returns to item 100 to continue printing.

The processes of increasing the tension of the transfer surface (item 118), increasing the marking material quantity setting (item 112), and decreasing the marking material quantity setting (item 114) change the tension of the transfer surface and the marking material quantity setting from relative normal settings. Further, this method returns the tension of the transfer surface and the marking material quantity setting to the relative normal settings when the excessive speed variation condition is absent in item 106. As used herein "normal" settings are those unadjusted settings used to perform printing; e.g., when no print setting adjustments are made to combat the short paper path condition, when the excessive speed variation is absent, and the primary printing function of the device is occurring.

Figure 2:
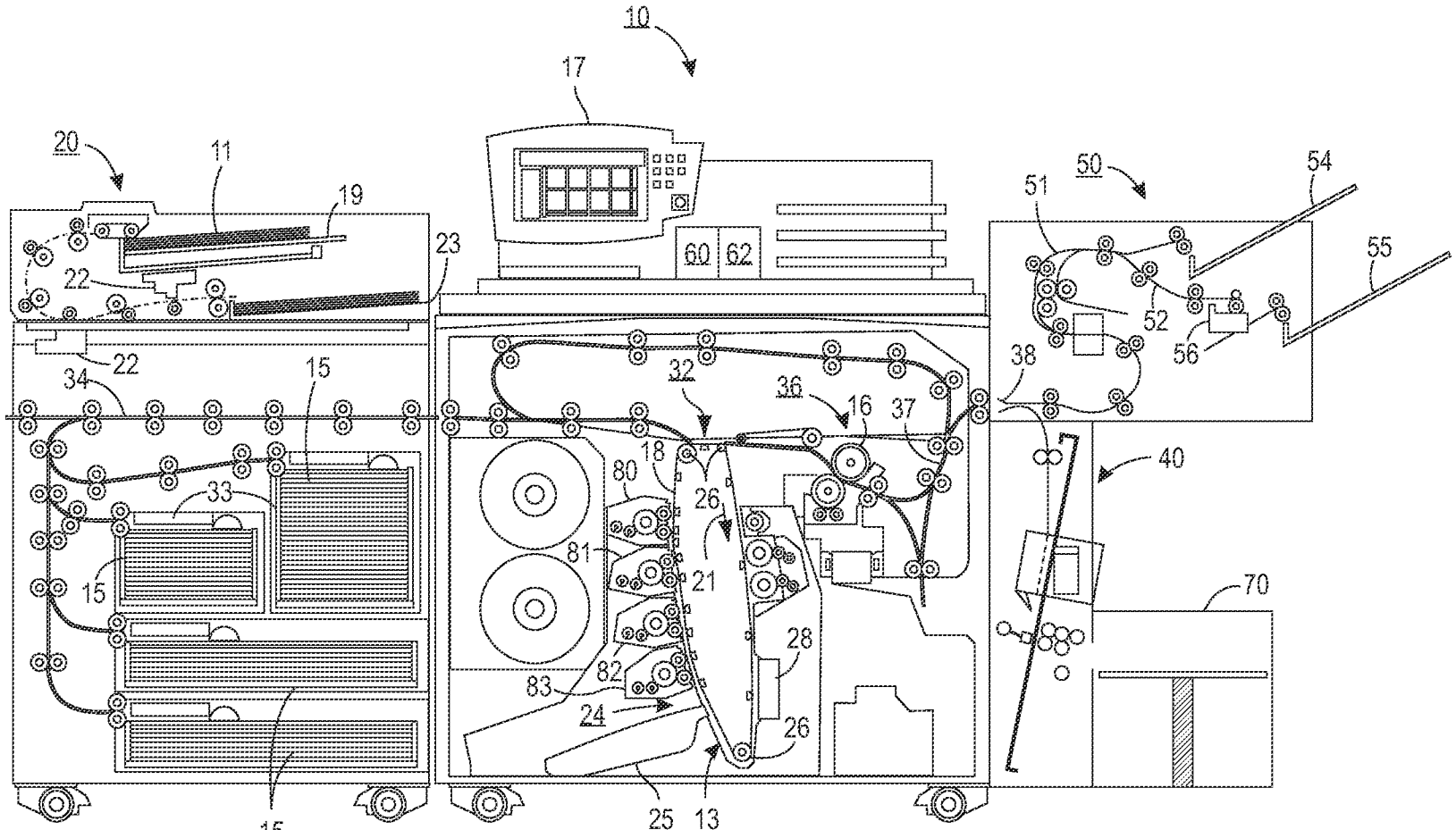
FIG. 2 is a schematic diagram illustrating devices herein.

Referring to FIG. 2 a printing machine 10 is shown that includes an automatic document feeder 20 (ADF) that can be used to scan (at a scanning station 22) original documents 11 fed from a tray 19 to a tray 23. The user may enter the desired printing and finishing instructions through the graphic user interface (GUI) or control panel 17, or use a job ticket, an electronic print job description from a remote source, etc. The control panel 17 can include one or more processors 60, power supplies, as well as storage devices 62 storing programs of instructions that are readable by the processors 60 for performing the various functions described herein. The storage devices 62 can comprise, for example, non-volatile tangible storage mediums including magnetic devices, optical devices, capacitor-based devices, etc.

An development units 80-83 pattern different colors of marking material on a surface 13 of a photoreceptor belt/intermediate transfer belt 18. The belt 18 here is mounted on a set of rollers/encoders 26. At least one of the rollers is driven to move the photoreceptor in the direction indicated by arrow 21 past the various other known processing stations including a charging station 28, imaging station 24 (for a raster scan laser system 25 that use a photoreceptor belt 18) or such elements can be included in the developing stations 80-83 (for systems that use an intermediate transfer belt 18) and transfer station 32. Note that devices herein can include a single development station 80, or can include multiple development stations 80-83 that use different color marking materials.

Thus, the latent image is developed with developing material to form a toner image corresponding to the latent image. More specifically, a sheet 15 is fed from a selected paper tray supply 33 to a sheet transport 34 for travel to the transfer station 32. There, the toned image is electrostatically transferred to a final print media material 15, to which it may be permanently fixed by a fusing device 16. The sheet is stripped from the photoreceptor 18 and conveyed to a fusing station 36 having fusing device 16 where the toner image is fused to the sheet. However, as noted above, large sheets can be held simultaneously by the transfer nip 32 and the fuser nip 36, which can cause printing defects. A guide can be applied to the substrate 15 to lead it away from the fuser roll. After separating from the fuser roll, the substrate 15 is then transported by a sheet output transport to output trays a multi-function finishing station 50.

Printed sheets 15 from the printer 10 can be accepted at an entry port 38 and directed to multiple paths and output trays 54, 55 for printed sheets, corresponding to different desired actions, such as stapling, hole-punching, C or Z-folding, cutting, binding, etc. The finisher 50 can also optionally include, for example, a modular booklet maker 40 although those ordinarily skilled in the art would understand that the finisher 50 could comprise any functional unit, and that the modular booklet maker 40 is merely shown as one example. The finished booklets are collected in a stacker 70. It is to be understood that various rollers and other devices, which contact and handle sheets within finisher module 50, are driven by various motors, solenoids and other electromechanical devices (not shown), under a control system, such as including the microprocessor 60 of the control panel 17 or elsewhere, in a manner generally familiar in the art.

Thus, the multi-functional finisher 50 has a top tray 54 and a main tray 55 and a folding and booklet making section 40 that adds stapled and unstapled booklet making, and single sheet C-fold and Z-fold capabilities. The top tray 54 is used as a purge destination, as well as, a destination for the simplest of jobs that require no finishing and no collated stacking. The main tray 55 can have, for example, a pair of pass-through sheet upside down staplers 56 and is used for most jobs that require stacking or stapling.

Thus, as shown in FIG. 2, an exemplary printing device includes a transfer surface 18 (e.g., a photoreceptor or an intermediate transfer belt) performing a printing activity that forms marks on sheets of print media 15 by transferring patterned marking material onto imaged areas of the sheets of print media 15 (and not transferring marking material onto non-imaged areas of the sheets of print media 15). Further, the exemplary printing device has an encoder 26 operatively connected to the transfer surface 18. The encoder 26 automatically monitors movement speed of the transfer surface 18. Also, a spectrophotometer 37 is adjacent the sheets of print media 15. The spectrophotometer 37 automatically monitors the amount of marking material being transferred to the non-imaged areas of the sheets of print media 15 during the printing activity. A processor 60 is operatively (meaning directly or indirectly) connected to the encoder 26 and the spectrophotometer 37. Also, a graphic user interface 17 is operatively connected to the processor 60.

The processor 60 automatically monitors variation of the movement speed of the transfer surface 18 based on output from the encoder 26. The processor 60 automatically determines if the variation of the movement speed of the transfer surface 18 exceeds a predetermined speed variation limit to identify an excessive speed variation condition. The processor 60 also automatically determines if the amount of the marking material being transferred to the non-imaged areas of the sheets of print media 15 exceeds a perceptibility threshold to identify an excessive background marking condition.

The processor 60 automatically increases a marking material quantity setting (e.g., a tone reproduction curve setting for one color (e.g., yellow) or multiple colors) when the excessive speed variation condition is present and the excessive background marking condition is absent. This process of increasing the marking material quantity setting is performed in increments up to a marking material quantity maximum setting.

Alternatively, the processor 60 automatically increases tension of the transfer surface 18 using an actuator in one or more of the rollers 26 and decreases the marking material quantity setting when the excessive speed variation condition is present and the excessive background marking condition is also present. The process of increasing tension of the transfer surface 18 is similarly performed in increments up to a tension maximum. The processor 60 decreases the marking material quantity setting by decreasing the marking material quantity setting to a relative minimum allowed for the marking material quantity setting within the printing device.

Otherwise, the processor 60 automatically provides a message on the graphic user interface 17 of the printing device when the excessive speed variation condition is present, the marking material quantity setting is at the marking material quantity maximum setting, and the tension of the transfer surface 18 is also at the tension maximum. The message provides instructions to use a different weight media or initiate a service call.

The processor 60 increases tension of the transfer surface 18, increases the marking material quantity setting, and decreases the marking material quantity setting by changing the tension of the transfer surface 18 and the marking material quantity setting from relative normal settings. The processor 60 returns the tension of the transfer surface 18 and the marking material quantity setting to the relative normal settings when the excessive speed variation condition is absent.

Also, the processor 60 continues the printing activity without interruption even while increasing tension of the transfer surface 18, increasing the marking material quantity setting, and decreasing the marking material quantity setting, until the excessive speed variation condition is present, the marking material quantity setting is at the marking material quantity maximum setting, and the tension of the transfer surface 18 is at the tension maximum (at which time, the processor 60 automatically provides the above message on the graphic user interface 17).

As would be understood by those ordinarily skilled in the art, the printing device 10 shown in FIG. 2 is only one example and the systems and methods herein are equally applicable to other types of printing devices that may include fewer components or more components. For example, while a limited number of printing engines and paper paths are illustrated in FIG. 2, those ordinarily skilled in the art would understand that many more paper paths and additional printing engines could be included within any printing device used with systems and methods herein.

Figure 3:
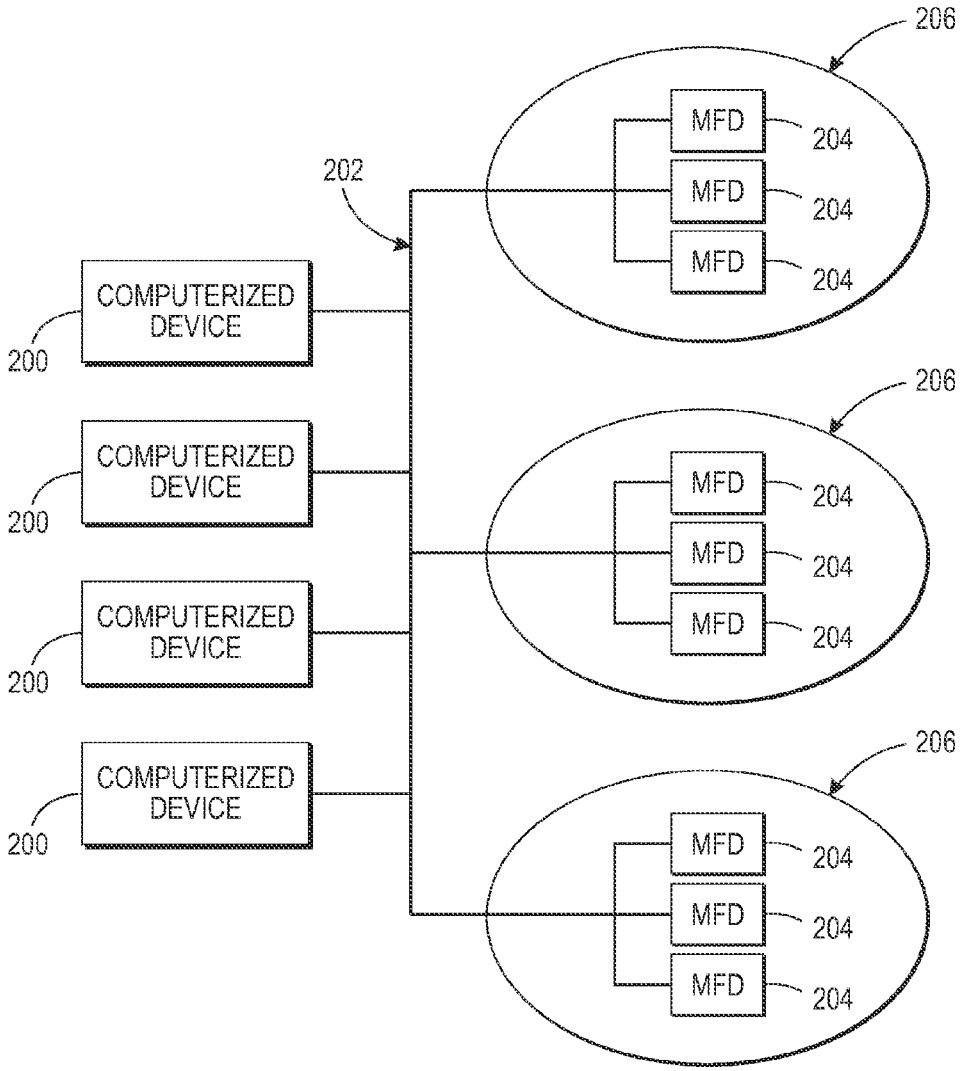
FIG. 3 is a schematic diagram illustrating systems herein.

As shown in FIG. 3, exemplary system systems and methods herein include various computerized devices 200, 204 located at various different physical locations 206. The computerized devices 200, 204 can include print servers, printing devices, personal computers, etc., and are in communication (operatively connected to one another) by way of a local or wide area (wired or wireless) network 202.

Figure 4:
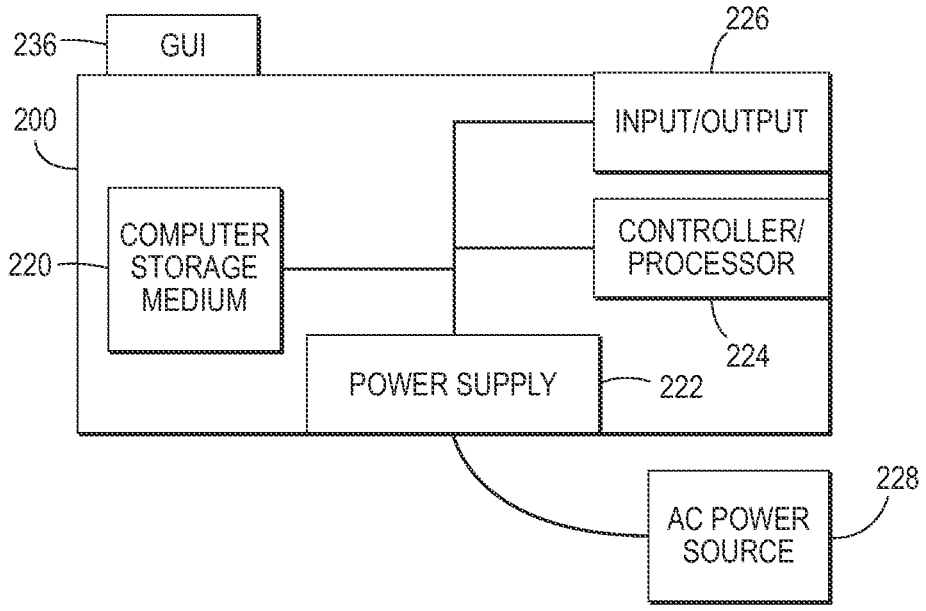
FIG. 4 is a schematic diagram illustrating devices herein.

FIG. 4 illustrates a computerized device 200, which can be used with systems and methods herein and can comprise, for example, a print server, a personal computer, a portable computing device, etc. The computerized device 200 includes a controller/processor 224 and a communications port (input/output) 226 operatively connected to the processor 224 and to the computerized network 202 external to the computerized device 200. Also, the computerized device 200 can include at least one accessory functional component, such as a graphic user interface assembly 236 that also operate on the power supplied from the external power source 228 (through the power supply 222).

The input/output device 226 is used for communications to and from the computerized device 200. The processor 224 controls the various actions of the computerized device. A non-transitory computer storage medium device 220 (which can be optical, magnetic, capacitor based, etc.) is readable by the processor 224 and stores instructions that the processor 224 executes to allow the computerized device to perform its various functions, such as those described herein. Thus, as shown in FIG. 4, a body housing has one or more functional components that operate on power supplied from an alternating current (AC) source 228 by the power supply 222. The power supply 222 can comprise a power storage element (e.g., a battery, etc).

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, processors, etc.) are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the systems and methods described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes. Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A method comprising:

automatically monitoring variation of movement speed of a transfer surface within a printing device performing a printing activity using a processor of said printing device, said printing activity comprising forming marks on sheets of print media, said transfer surface transferring patterned marking material onto imaged areas of said sheets of print media and not transferring marking material onto non-imaged areas of said sheets of print media;

automatically monitoring an amount of marking material being transferred to said non-imaged areas of said sheets of print media during said printing activity using said processor;

automatically determining if said variation of movement speed of said transfer surface exceeds a predetermined speed variation limit to identify an excessive speed variation condition using said processor;

automatically determining if said amount of said marking material being transferred to said non-imaged areas of said sheets of print media exceeds a perceptibility threshold to identify an excessive background marking condition using said processor;

automatically increasing a marking material quantity setting based on said excessive speed variation condition being present and said excessive background marking condition being absent using said processor, said increasing said marking material quantity setting being performed in increments up to a marking material quantity maximum setting;

automatically increasing tension of said transfer surface and decreasing said marking material quantity setting based on said excessive speed variation condition being present and said excessive background marking condition being present using said processor, said increasing tension of said transfer surface being performed in increments up to a tension maximum; and automatically providing a message on a graphic user interface of said printing device based on said excessive speed variation condition being present, said marking material quantity setting being at said marking material quantity maximum setting, and said tension of said transfer surface being at said tension maximum, said message providing instructions to one of use a different type media and initiate a service call.

2. The method according to claim 1, said decreasing said marking material quantity setting comprising decreasing said marking material quantity setting to a relative minimum allowed for said marking material quantity setting within said printing device.

3. The method according to claim 1, said increasing tension of said transfer surface, said increasing said marking material quantity setting, and said decreasing said marking material quantity setting changing said tension of said transfer surface and said marking material quantity setting from relative normal settings.

4. The method according to claim 3, further comprising returning said tension of said transfer surface and said marking material quantity setting to said relative normal settings based on said excessive speed variation condition being absent.

5. The method according to claim 1, further comprising continuing said printing activity without interruption during said increasing tension of said transfer surface, said increasing said marking material quantity setting, and said decreasing said marking material quantity setting until said excessive speed variation condition is present, said marking material quantity setting is at said marking material quantity maximum setting, and said tension of said transfer surface is at said tension maximum.

6. The method according to claim 1, said marking material quantity setting comprising a tone reproduction curve setting.

7. The method according to claim 1, said transfer surface comprising one of a photoreceptor and an intermediate transfer belt.

8. A method comprising:

automatically monitoring variation of movement speed of a transfer surface within a printing device performing a printing activity using a processor of said printing device, said printing activity comprising forming marks on sheets of print media, said transfer surface transferring patterned marking material onto imaged areas of said sheets of print media and not transferring said marking material onto non-imaged areas of said sheets of print media;

automatically monitoring an amount of marking material of a single color being transferred to said non-imaged areas of said sheets of print media during said printing activity using said processor;

automatically determining if said variation of movement speed of said transfer surface exceeds a predetermined speed variation limit to identify an excessive speed variation condition using said processor;

automatically determining if said amount of said marking material of said single color being transferred to said non-imaged areas of said sheets of print media exceeds a perceptibility threshold to identify an excessive background marking condition using said processor;

automatically increasing a marking material quantity setting based on said excessive speed variation condition being present and said excessive background marking condition being absent using said processor, said increasing said marking material quantity setting being performed in increments up to a marking material quantity maximum setting;

automatically increasing tension of said transfer surface and decreasing said marking material quantity setting based on said excessive speed variation condition being present and said excessive background marking condition being present using said processor, said increasing tension of said transfer surface being performed in increments up to a tension maximum; and automatically providing a message on a graphic user interface of said printing device based on said excessive speed variation condition being present, said marking material quantity setting being at said marking material quantity maximum setting, and said tension of said transfer surface being at said tension maximum, said message providing instructions to one of use a different type media and initiate a service call.

9. The method according to claim 8, said decreasing said marking material quantity setting comprising decreasing said marking material quantity setting to a relative minimum allowed for said marking material quantity setting within said printing device.

10. The method according to claim 8, said increasing tension of said transfer surface, said increasing said marking material quantity setting, and said decreasing said marking material quantity setting changing said tension of said transfer surface and said marking material quantity setting from relative normal settings.

11. The method according to claim 10, further comprising returning said tension of said transfer surface and said marking material quantity setting to said relative normal settings based on said excessive speed variation condition being absent.

12. The method according to claim 8, further comprising continuing said printing activity without interruption during said increasing tension of said transfer surface, said increasing said marking material quantity setting, and said decreasing said marking material quantity setting until said excessive speed variation condition is present, said marking material quantity setting is at said marking material quantity maximum setting, and said tension of said transfer surface is at said tension maximum.

13. The method according to claim 8, said marking material quantity setting comprising a tone reproduction curve setting.

14. The method according to claim 8, said transfer surface comprising one of a photoreceptor and an intermediate transfer belt.

15. A printing device comprising:

a transfer surface performing a printing activity comprising forming marks on sheets of print media by transferring patterned marking material onto imaged areas of said sheets of print media and not transferring marking material onto non-imaged areas of said sheets of print media;

an encoder operatively connected to said transfer surface, said encoder automatically monitoring movement speed of said transfer surface;

a spectrophotometer adjacent said sheets of print media, said spectrophotometer automatically monitoring an amount of marking material being transferred to said non-imaged areas of said sheets of print media during said printing activity;

a processor operatively connected to said encoder and said spectrophotometer; and a graphic user interface operatively connected to said processor, said processor automatically monitoring variation of said movement speed of said transfer surface based on output from said encoder, said processor automatically determining if said variation of said movement speed of said transfer surface exceeds a predetermined speed variation limit to identify an excessive speed variation condition;

said processor automatically determining if said amount of said marking material being transferred to said non-imaged areas of said sheets of print media exceeds a perceptibility threshold to identify an excessive background marking condition;

said processor automatically increasing a marking material quantity setting based on said excessive speed variation condition being present and said excessive background marking condition being absent, said increasing said marking material quantity setting being performed in increments up to a marking material quantity maximum setting;

said processor automatically increasing tension of said transfer surface and decreasing said marking material quantity setting based on said excessive speed variation condition being present and said excessive background marking condition being present, said increasing tension of said transfer surface being performed in increments up to a tension maximum, said processor automatically providing a message on said graphic user interface of said printing device based on said excessive speed variation condition being present, said marking material quantity setting being at said marking material quantity maximum setting, and said tension of said transfer surface being at said tension maximum, and said message providing instructions to one of use a different type media and initiate a service call.

16. The printing device according to claim 15, said processor decreasing said marking material quantity setting by decreasing said marking material quantity setting to a relative minimum allowed for said marking material quantity setting within said printing device.

17. The printing device according to claim 15, said processor increasing tension of said transfer surface, increasing said marking material quantity setting, and decreasing said marking material quantity setting by changing said tension of said transfer surface and said marking material quantity setting from relative normal settings, and said processor returning said tension of said transfer surface and said marking material quantity setting to said relative normal settings based on said excessive speed variation condition being absent.

18. The printing device according to claim 15, said processor continuing said printing activity without interruption during said increasing tension of said transfer surface, said increasing said marking material quantity setting, and said decreasing said marking material quantity setting until said excessive speed variation condition is present, said marking material quantity setting is at said marking material quantity maximum setting, and said tension of said transfer surface is at said tension maximum.

19. The printing device according to claim 15, said marking material quantity setting comprising a tone reproduction curve setting.

20. The printing device according to claim 15, said transfer surface comprising one of a photoreceptor and an intermediate transfer belt.

* * * * *